United States Patent [19]

Kohl

[11] 4,192,158

[45] Mar. 11, 1980

[54] WEFT THREAD TENSIONING DEVICE FOR WARP KNITTING MACHINES

[75] Inventor: Karl Kohl, Obertshausen, Fed. Rep. of Germany

[73] Assignee: Karl Mayer Textilmaschinenfabrik GmbH, Obertshausen, Fed. Rep. of Germany

[21] Appl. No.: 931,778

[22] Filed: Aug. 7, 1978

[30] Foreign Application Priority Data

Aug. 17, 1977 [DE] Fed. Rep. of Germany ..... 2736976

[51] Int. Cl.[2] ..... D04B 15/44

[52] U.S. Cl. ..... 66/146; 66/213; 66/84 A

[58] Field of Search ..... 66/125 R, 146, 213, 66/84 A

[56] References Cited

U.S. PATENT DOCUMENTS 3,774,414 11/1973 Vogel ..... 66/84 A

*Primary Examiner*—Ronald Feldbaum
*Attorney, Agent, or Firm*—Omri M. Behr

[57] ABSTRACT

A weft thread tensioning device for use on a warp knitting machine provides a means for testing the tension of the weft threads and, if the threads are not at the desired tension, tensioning the threads to a predetermined amount. The device includes a spring loaded lever and U-shaped bracket which adjust the tension on the weft thread just prior to insertion into the bed of the knitting machine.

7 Claims, 3 Drawing Figures

WEFT THREAD TENSIONING DEVICE FOR WARP KNITTING MACHINES

BACKGROUND OF THE INVENTION

The present invention relates to warp knitting machines having a magazine type weft insertion devices, and more particularly, relates to a means for testing and tensioning the weft thread delivered to the bed of the warp knitting machine by the weft insertion magazine device at a point just prior to the insertion of the weft thread.

DESCRIPTION OF THE PRIOR ART

Prior art warp knitting machines having magazine type weft insertion arrangements require that the weft threads be provided under substantially high tension prior to their insertion into the thread brake of the magazine. This is necessary in order to prevent and/or reduce the likelihood of the weft thread segments becoming loose while they are held by the clamps affixed on the weft thread insertion magazine device. Generally, this leads to an excessively high thread tension, which leads to thread breakage, or alternatively the thread tension is insufficient for the desired purpose and it becomes necessary to provide, within the weft thread magazine itself, a further means for insuring adequate thread tension.

Therefore, it has generally been the practice to try and avoid such arrangements and in place thereof the magazine chains have generally been oriented at an angle slightly greater than 90° relative to the axis of the needle bed rather than being perpendicular thereto. Thus, as the weft threads travel in a forward direction toward the needle bed, for insertion therein, the tension on the weft threads is automatically increased. The disadvantage of this type of arrangement is that all weft threads receive the same amount of increased tension. Some threads may already have adequate tension thereon, and thus, with the tension increased, breaking thereof frequently occurs. To overcome the thread breaking problem the tension on all the warp threads are reduced, which leads to inadequate thread tension resulting in undesirable defects in the final cloth. Thus, it is apparent to the knowledgeable in the art, that the positioning or biasing of the magazine chains does not provide a method of controlling the tension on each individual weft thread prior to insertion.

SUMMARY OF THE INVENTION

The present invention overcomes the shortcomings in the prior art by providing on at least one side of the warp knitting machine, just rearwardly of the needle bed, a device for testing of the thread tension and adjusting the tension thereto if found to be insufficient just before the thread is transferred to the needle bed. If the thread tension is found to be adequate for insertion into the needle bed, the thread tensioning device is not activated and the weft thread is laid in under its original tension. The tension setting that is to be applied to each of the weft threads is readily adjustable with the aid of a spring loaded tensioning device. By utilizing the present arrangement the weft threads can be led through the major portion of the magazine until just before the lay in point without any tension control whatsoever. This permits the weft threads to be inserted into the magazine at the thread cutting point under comparatively low tension. In addition, if for some reason, the tension of an individual thread should drop during its passage through the magazine, this will be remedied just prior to insertion into the bed of the machine.

A weft thread tensioning device, according to the principles of the present invention, for a warp knitting machine which has a needle bar with a plurality of needles affixed thereon forming a needle bed, at least two guide bars with a plurality of guides affixed thereon and a magazine insertion device for inserting weft threads by presenting the threads to the needle bed, comprises means for testing the tension of the weft threads, prior to presentment to the needle bed and means for tensioning the weft threads, just prior to presentment to the needle bed, to a predetermined amount when the threads are below the predetermined tension amount.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1:
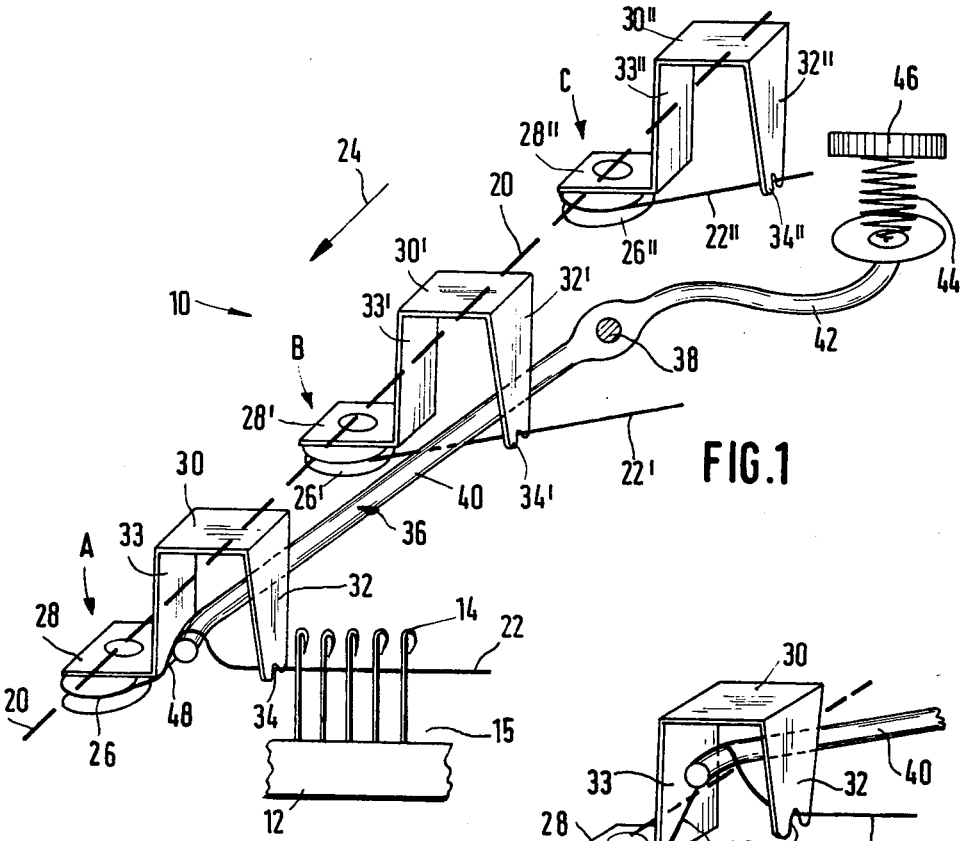
FIG. 1 is a pictorial perspective view of the tensioning device viewed from the front of a warp knitting machine.
Figure 2:
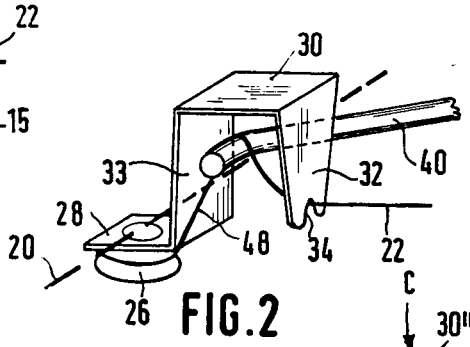
FIG. 2 is a view of the thread tensioning portion of the device shown in FIG. 1 illustrating the means for supplying tension to the warp thread.

Referring now to the figures, and in particular to FIG. 1, there is shown a tensioning device 10 which is to be used on a warp knitting machine, not shown in its entirety, but includes a needle bar 12 which has affixed thereto, in a conventional manner, a plurality of needles 14. The area 15 proximate the needles and behind the openings thereto will hereinafter be referred to as the needle bed. The warp knitting machine additionally includes guide bars 16 and 17 (FIG. 2) and a sinker 18.

The circulating chain portion 20 of a magazine weft insertion device, as viewed from the front of the warp knitting machine, is indicated by the broken line shown in FIG. 1. An example of a magazine type weft inserting apparatus for warp knitting machines is disclosed in U.S. Pat. No. 3,916,649 to Karl Kohl.

The weft threads 22, 22' and 22'' move with the magazine chain 20 in the direction of arrow 24, which is towards the front of the warp knitting machine. Provided on the magazine chain 20 are conventional thread clamps 26, 26' and 26'' which are spaced therealong and attached to the chain 20 in a conventional manner. The extending portion 28, 28' and 28'' of U-shaped bracket 30, 30' and 30'' are affixed to the upper portion of the thread clamps 26, 26' and 26'' in a conventional manner. The U-shaped bracket 30 is provided with two arms 32 and 33. Arm 32 extends downwardly and is provided with a thread guide slot 34 at the tip thereof. Arm 33 is connected to the extending portion 28 which is used for mounting the U-shaped bracket 30 to the thread clamp 26, as explained heretofore.

The chain 20 moves in direction of arrow 24 and thus the U-shaped bracket 30'' in position C will move to position B and become bracket 30' and thence to position A as bracket 30. Each of the brackets 30, 30' and 30" are identical, and in the preferred embodiment of the invention, are evenly spaced around the magazine chain 20.

A rotatable lever 36 which is adapted to pivot about shaft 38 is provided with a front portion 40 which is located proximate the end of the needle bed 15. The lever 36 is adjustable to a predetermined tension by changing the spring pressure to the rear portion 42 of the lever 36. The spring pressure is generated by a spring 44 which is compressed by a knob 46 in a conventional manner.

In operation, the lever 36 has its front portion 40 placed between the chain 20 and the opening in the Ushaped bracket 30, which functions as a thread support means. The warp thread 22 extends from the thread clamp 26 across the opening of U-shaped clamp 30 and through thread guide slot 34 to the other end of the magazine chain which has disposed thereon a thread clamp similar to clamp 26. At position C, shown in FIG. 1, the weft thread 22 rides over the lever 36 as it moves in the direction of arrow 24. When the weft thread 22 reaches position B it actually comes into contact with the spring loaded lever 36. If at this point the weft thread 22 has the proper tension corresponding to the setting of spring 44 then the lever 36 acting as a thread tension testing device does not act upon the thread 22. Alternatively, if the tension on the weft thread 22 at position B is too low then, under the influence of spring 44, the front portion 40 of lever 36 moves in an upwardly direction to the opening between chain 20 and the arm 32 of the U-shaped bracket 30. By the time position A is reached by the weft thread 22 a certain portion 48 of weft thread 22 has been taken up increasing the tension of thread 22. This is shown more clearly in FIG. 2. In this manner the tension of thread 22 has been raised to the predetermined level set by the tension applied by spring 44 and thus, under the proper tension, the thread 22 is then laid into the needle bed 15.

Figure 3:
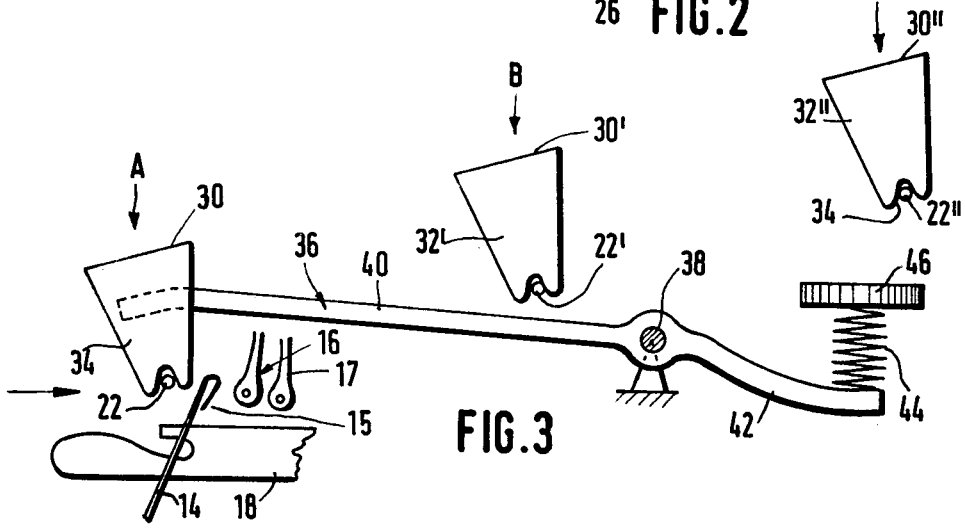
FIG. 3 is a side schematic view in elevation of the device of the present invention viewed along the axis of the needle bed.

The movement of the weft threads from position C to B to A is shown in FIG. 3 in cross section with the relative position of the other parts of the warp knitting machine. It is obvious from FIG. 3, that the weft thread 22 is released from the front portion 40 of lever 36 just at the point when the guides 16 and 17 are in the overlap position behind the needles 14.

In the preferred embodiment of the invention the axis of rotation about shaft 38 is so chosen that after the removal of the weft thread 22 from the front portion 40 of lever 36 the weft thread 22', which is in position B, is not in contact with the front portion 40 of lever 36. The throw, or vertical movement of the front portion 40 of lever 36 is controlled by the maximum expansion of spring 44. Alternatively, a stop, not shown, may be used to control the maximum height of movement of the front portion 40 of lever 36.

Hereinbefore has been disclosed a weft thread tensioning device for use with warp knitting machines which can test the tension of the weft threads prior to presentment to the needle bed and is capable of adjusting the tension thereof to a predetermined value just prior to the insertion into the needle bed of the machine. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A weft thread tensioning device for a warp knitting machine having a needle bar with a plurality of needles affixed thereon forming a needle bed, at least two guide bars with a plurality of guides affixed thereon and a magazine insertion device for inserting weft threads by presenting said threads to said needle bed, comprising:
   (a) means of testing the tension of said weft threads, prior to presentment to said needle bed; and
   (b) means for tensioning said weft threads just prior to presentment to said needle bed to a predetermined amount when said threads are below said predetermined tension amount.

2. A weft thread tensioning device according to claim 1, wherein said testing means and said tensioning means are included in a single device having a spring biased lever.

3. A weft thread tensioning device according to claim 1, further including:
   (a) a plurality of thread clamps disposed on the feed chains of said magazine;
   (b) a plurality of thread support means disposed proximate said thread clamps; and
   (c) a sensing and tensioning lever cooperating with said thread support means to insure that said weft threads are set to a predetermined tension level.

4. A weft thread tensioning device according to claim 3, wherein said thread support means is provided with a thread guide slot disposed at the same height as said needle bed at the point said weft threads are laid therein.

5. A weft thread tensioning device according to claim 1, wherein said testing means and said tensioning means act upon each said weft thread when said guide bars are in the overlap position behind the needles.

6. A weft thread tensioning device according to claim 1, wherein said testing means and said tensioning means act only upon one weft thread at a time.

7. A weft thread tensioning device according to claim 3, wherein said thread support means is U-shaped and inverted, one of the arms of said U-shaped support is provided with an extending portion adapted to be affixed to each of said thread clamps, the other arm of said U-shaped support is provided with a thread guide slot for receiving one of said weft threads therein, said sensing and tensioning lever being adapted to freely move within said U-shaped opening and interact with said weft thread to adjust the tension thereof.

* * * * *